US007723275B2

(12) United States Patent
Patel et al.

(10) Patent No.: US 7,723,275 B2
(45) Date of Patent: May 25, 2010

(54) ANTI-SEIZE COMPOSITION IN SOLID FORM

(75) Inventors: Prakash S. Patel, Algonquin, IL (US); Shabbir Attarwala, Simsbury, CT (US)

(73) Assignee: Henkel Corporation, Rocky Hill, CT (US)

( * ) Notice: Subject to any disclaimer, the term of this patent is extended or adjusted under 35 U.S.C. 154(b) by 363 days.

(21) Appl. No.: 11/777,383

(22) Filed: Jul. 13, 2007

(65) Prior Publication Data

US 2008/0011776 A1 Jan. 17, 2008

Related U.S. Application Data

(62) Division of application No. 10/282,424, filed on Oct. 29, 2002, now Pat. No. 7,244,696.

(60) Provisional application No. 60/330,722, filed on Oct. 29, 2001, provisional application No. 60/386,420, filed on Jun. 7, 2002.

(51) Int. Cl.
*C10M 125/00* (2006.01)
*C10M 169/06* (2006.01)

(52) U.S. Cl. ..... 508/150; 508/116; 508/148; 508/155; 508/167; 508/175; 508/178; 508/180; 508/181; 508/450; 508/451; 508/464; 508/469; 508/471; 508/551

(58) Field of Classification Search ..... 508/150, 508/154, 155, 180, 167
See application file for complete search history.

(56) References Cited

U.S. PATENT DOCUMENTS 3,652,414 A * 3/1972 Bergeron ..... 508/119
4,091,123 A 5/1978 Ayusawa
4,314,924 A 2/1982 Haubennestel et al. ..... 260/30
4,331,580 A 5/1982 Bunyan ..... 523/176
4,410,644 A 10/1983 Bunyan ..... 523/176
4,956,109 A 9/1990 Tanikawa ..... 252/48
5,093,015 A 3/1992 Oldiges et al. ..... 252/23
5,180,509 A 1/1993 Jacobs ..... 252/22
5,286,393 A 2/1994 Oldiges et al. ..... 252/25
5,348,668 A 9/1994 Oldiges et al. ..... 252/26

(Continued)

FOREIGN PATENT DOCUMENTS

GB 891049 3/1962

(Continued)

*Primary Examiner*—Ellen M McAvoy
(74) *Attorney, Agent, or Firm*—Steven C. Bauman

(57) ABSTRACT

An anti-seize composition which is non-flowable and dimensionally stable at temperatures greater than about 120° F. and dispensable at room temperature without the application of heat is provided. The composition includes a solid anti-seize lubricant, such as of metallic copper, metallic nickel, metallic aluminum, metallic lead, metallic zinc, graphite, calcium oxide, calcium carbonate, calcium fluoride, calcium stearate, lithium, molybdenum disulfide, boron nitride, barium sulfate. or combinations thereof. The anti-seize lubricant is dispersed in a carrier which is a solid at about room temperature. The carrier includes a grease with an ASTM D 217 penetration at 25° C. from about 200 to about 400 mm, a matrix material, and a naphthenic petroleum oil having a viscosity of less than about 300 SUS at 100° F. and having an API gravity at 60° F. from about 23 to about 25. The matrix material is a polymeric material. Optionally, a refined petroleum wax may also be included.

25 Claims, 2 Drawing Sheets

U.S. PATENT DOCUMENTS

| | | | | |
|---|---|---|---|---|
| 5,498,351 | A | 3/1996 | Hefling | 252/26 |
| 5,536,422 | A | 7/1996 | Oldiges et al. | 252/23 |
| 5,547,503 | A | 8/1996 | Oldiges et al. | 106/287 |
| 5,589,443 | A * | 12/1996 | Denton et al. | 508/150 |
| 5,885,941 | A | 3/1999 | Sateva et al. | 508/121 |
| 6,245,721 | B1 * | 6/2001 | Chun et al. | 508/151 |
| 6,451,927 | B1 | 9/2002 | Burdzy | 525/426 |
| 6,528,457 | B2 * | 3/2003 | Howell et al. | 508/180 |
| 6,620,460 | B2 * | 9/2003 | Oldiges et al. | 427/409 |
| 6,960,555 | B2 * | 11/2005 | Anthony et al. | 508/136 |
| 7,091,161 | B2 * | 8/2006 | Oldiges et al. | 508/154 |
| 7,244,696 | B2 * | 7/2007 | Patel et al. | 508/150 |

FOREIGN PATENT DOCUMENTS

| | | |
|---|---|---|
| GB | 2223504 | 4/1990 |
| JP | 54-123105 | 9/1979 |
| JP | 11-106779 | 4/1999 |
| WO | WO/00/044528 | 8/2000 |
| WO | WO/00/025628 | 5/2001 |
| WO | WO/01/091915 | 12/2001 |
| WO | WO/01/092430 | 12/2001 |
| WO | WO/01/092434 | 12/2001 |
| WO | WO/01/092435 | 12/2001 |

* cited by examiner

ANTI-SEIZE COMPOSITION IN SOLID FORM

CROSS REFERENCE TO RELATED APPLICATIONS

This application is a division of U.S. patent application Ser. No. 10/282,424, filed Oct. 29, 2002 now U.S. Pat. No. 7,244,696, which claims the benefit of earlier filing dates from U.S. Provisional Application No. 60/386,420 filed Jun. 7, 2002 and U.S. Provisional Application No. 60/330,722, filed Oct. 29, 2001.

BACKGROUND OF THE INVENTION

1. Field of the Invention

The present invention relates to lubricant compositions useful for preventing seizing of threaded fasteners. More particularly, the present invention relates to anti-seize lubricant compositions in non-flowable or solid form, which can be packaged in a convenient pocket-sized applicator dispenser.

2. Brief Description of Related Technology

U.S. Patent No. 5,498,351 (Heffling) claims a process for making anti-seize lubricant compositions, and sets forth compositions of this type which include naphthenic oil, lubricating grease, graphite, silicon fluid, and metal flake/oil suspension (65% aluminum flake and 35% oil). The compositions described are not in a solid form, but are generally formed as paste-like consistencies and are typically applied by dipping or brushing techniques.

Henkel Loctite Corporation has sold many flowable anti-seize lubricant compositions. For instance, C5-A Copper Anti-Seize is a suspension of copper and graphite in a high-quality grease, which protects metal parts from rust, corrosion, galling, and seizing at temperatures to 1800° F. (982° C.), and tested to MIL(PRF)-A-907-E; Nickel Anti-Seize is a copper-free product, recommended for stainless steel and other metal fittings to prevent corrosion, seizing, and galling in harsh, chemical environments, and temperatures to 2400° F. (1315° C.); Moly Paste is a low friction product, which lubricates press fits, protects during break-in and under high static loads up to 750° F. (400° C.); Silver Grade Anti-Seize is a temperature-resistant, petroleum-based inert lubricant compound fortified with graphite and metallic flake, which will not evaporate or harden in extreme cold or heat and is for use in assemblies up to 1600° F. (871° C.); Heavy Duty, Anti-Seize is a metal free product, which provides excellent lubricity, outstanding lubrication to all metals including stainless steel, aluminum, and soft metals up to 2400° F. (1315° C.,), Marine Grade Anti-Seize is formulated to protect assemblies exposed directly or indirectly to fresh and salt water; Marine Grade Anti-Seize works well in high humidity conditions, and has excellent lubricity, superior water wash-out and water spray resistance, and prevents galvanic corrosion, protects in temperatures from −29° C. to 1315° C., (−20° F. to 2400° F.); Graphite-50 Anti-Seize is an electrically conductive, non-metallic product, which is temperature resistant up to 900° F. (482° C.); Moly-50 Anti-Seize is a thread lubricant, which is temperature resistant to 750° F. (400° C.) and provides excellent lubricity; Zinc Anti-Seize protects aluminum and ferrous surfaces from seizure and corrosion up to 750° F. (400° C.); Food Grade Anti-Seize prevents seizure, galling, and friction in stainless steel and other metal parts up to 750° F. (400° C.); N-1000 High Purity Anti-Seize is a copper-based product, which is suitable for long-term, stainless steel applications and high-nickel, alloy bolting; N-5000 High Purity Anti-Seize is a nickel-based product, which lubricates and protects Class 1, 2 and 3 power plant hardware and is recommended for highly corrosive environments to 2400° F. (1315° C.); High Performance N-5000 High Purity Anti-Seize is also a nickel-based product, which provides maximum lubricating and anti-seize properties for Class 1, 2 and 3 power plant hardware. Temperature resistant to 2400° F. (1315° C.); N-7000 High Purity Anti-Seize is a metal-free product which provides high levels of purity and excellent lubricating properties for Class 1, 2

Other commercial anti-seize formulations in semi-solid form are available. For example, AS-201 Stick is a semi-solid anti-seize formulation offered by Dyna Systems, Dallas, Tex. This product is offered in a twist-up holder, but is a relatively soft semi-solid which retards retractability back into the container. Furthermore, the product is described as having storage and handling limitation of less than about 120° F. Kar Products of Des Plaines, Ill., markets a Kar Anti-Seize Stick. The stick is made from aluminum complex grease, paraffin wax, microcrystalline wax, aluminum powder and copper powder. The stick is a hard wax-based formulation, which is not typically amenable to good spreadability over substrate surfaces. Hard waxes also tend to crumble or crack, which also causes poor spreadability.

There is a need for an anti-seize composition in solid form having sufficient spreadability to evenly coat substrate surfaces while having dimensional stability to be stored and retractably dispensed from a container. More particularly, there is a need in the art for a non-flowable anti-seize formulation having dimensional stability up to and exceeding 120° F. so that it may be used in a variety of industrial settings.

SUMMARY OF THE INVENTION

The present invention satisfies a product profile, which confers anti-seize properties up to a temperature of about 1800° F. or greater onto parts on which the inventive formulation is applied. The anti-seize stick formulation has dimensional stability of up to 120° F. (50° C.) or greater, for instance 130° F. (55° C.) or greater, indicating that the formulation supports its own weight and does not change shape under gravitational forces. Moreover, the anti-stick formulation of the present invention is not so hard, often having a penetration value less than 400 dmm, as to retard even spreadability. Desirably, the anti-seize composition of the present invention includes one or more anti-seize lubricants, a matrix material, such as a polymeric material, a grease and an oil, such that the above desirable properties are satisfied.

In one aspect of the present invention, an anti-seize composition includes, but is not limited to, a solid anti-seize lubricant selected from the group consisting of metallic copper, metallic nickel, metallic aluminum, metallic lead, metallic zinc, graphite, calcium oxide, calcium carbonate, calcium fluoride, calcium stearate, lithium, molybdenum disulfide, boron nitride, barium sulfate, or combinations thereof and a carrier for dispersing the lubricant. The carrier includes grease, oil and a matrix material. The matrix material is a polymeric material, for instance a hydroxy or amine modified aliphatic hydrocarbon polymeric material having a melting point from about 170° F. to about 200° F. The carrier is present in an amount to render the composition dimensionally stable and non-flowable at temperatures greater than about 120° F. Moreover, the composition is dispensable at room temperature without the application of heat and has an unworked ASTM D 217 penetration at 25° C. from about 20 to about 100 tenths of a millimeter. Optionally, a wax, for instance a refined paraffin wax with a viscosity. of less than about 200 SUS at 100° F. may also be included.

In another aspect of the present invention, an anti-seize composition having a MIL(PRF)-A-907E breakaway torque of less than 250 foot-pounds includes, but is not limited to, a solid anti-seize lubricant and a carrier dispersing lubricant, where the composition is dispensable and spreadable at room temperature without the application of heat. The carrier includes, but is not limited to, grease, oil and a matrix material. The matrix material is a polymeric material, for instance a hydroxy or amine modified aliphatic hydrocarbon polymeric material having a melting point from about 170° F. to about 200° F. The carrier is present in an amount to render the composition dimensionally stable and non-flowable at about room temperature or greater. Optionally, a wax, for instance a refined paraffin wax with a viscosity of less than about 200 SUS at 100° F., may also be included.

In yet another aspect of the present invention, an anti-seize composition is provided which includes, but is not limited to, a solid anti-seize lubricant selected from the group consisting of metallic copper, metallic nickel, metallic aluminum, metallic lead, metallic zinc, graphite, calcium oxide, calcium carbonate, calcium fluoride, calcium stearate, lithium, molybdenum disulfide, boron nitride, barium sulfate, or combinations thereof and a carrier which is a solid at about room temperature or greater and having the lubricant dispersed therein. The carrier includes a grease, a naphthenic petroleum oil having a viscosity of less than about 300 SUS at 100° F. and having an API gravity at 60° F. from about 23 to about 25, and a polymeric material, for instance, a hydroxy, amide or amine modified aliphatic hydrocarbon polymeric material having a melting point from about 170° F. to about 200° F. The composition is dispensable at room temperature without the application of heat. Optionally, a wax, for instance, a refined paraffin wax with a viscosity of less than about 200 SUS at 100° F., may also be included.

The present invention also contemplates a method of making the non-flowable anti-seize composition, as well as a method of using the non-flowable anti-seize composition The present invention also contemplates an article of manufacture. In this embodiment there is included a dispensing container for housing and dispensing a non-flowable anti-seize composition. The container includes a generally elongate hollow body having first and second ends, with one of the ends having a dispense opening. The container houses the non-flowable anti-seize composition.

It is surprising to be able to manufacture an anti-seize formulation, such as one that performs along the lines of one or more of the Loctite anti-seize products described above in a solid, yet spreadable, form, because much of the anti-seize compositions are non-polar, liquid hydrocarbons, whereas the polymeric materials used in the inventive anti-seize compositions are solids, which are more polar in nature. The polarity difference inherently renders the two types of materials physically incompatible and the liquid nature of the one and the solid nature of the other also adds to their incompatibility.

The present invention overcomes these issues of incompatibility by mixing the two types of materials at elevated temperature conditions sufficient to render the mixture a substantially homogenous flowable mass.

DETAILED DESCRIPTION OF THE INVENTION

Figure 1:
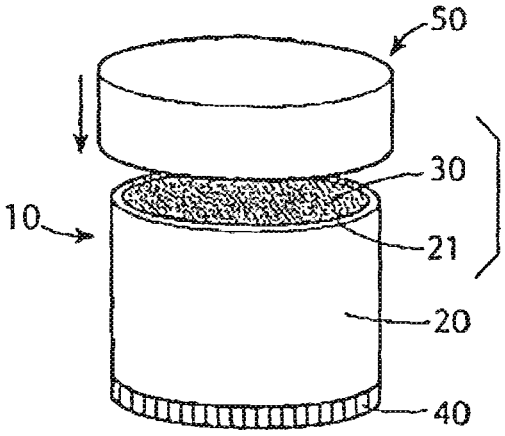
FIG. 1 is a perspective view of a lipstick-type dispenser container with a dispenser cap.

The anti-seize compositions of the present invention are non-flowable and dimensionally stable, i.e., they are capable of existing in a self-supporting mass without migrating at temperatures of at least 70° F., (21° C.), desirably 120° F. (49° C.) up to at least about 130° F. (55° C.). In practical applications, these compositions are provided in an applicator such that they can be conveniently dispensed to the desired location, such as by a pocket-sized or hand-held lipstick-type container, which can be easily carried by a mechanic or maintenance worker for use as needed. Such a dispenser, within which is dispensed on the inventive anti-seize composition, solves many problems, such as spillage in the environment in which it is used, which can be particularly problematic where sensitive parts are present and susceptible of contamination or when migration of an anti-seize composition is generally undesirable.

The present invention provides anti-seize compositions in a spreadable, yet dimensionally stable and solid form. The inventive compositions are based on an oil, a grease, a matrix material, such as a polymeric matrix material, and a high melting point metal powder (such as copper powder), and/or graphite. These different constituents are further described hereinafter. Optionally, the inventive formulation may also include a wax, particularly a refined paraffin wax with a viscosity of less than about 200 SUIS at 100° F.

The inventive solid anti-seize lubricant composition includes anti-seize lubricants, which are high melting point particles, such as powders or flakes. Useful high melting point particles include those having an average melting point temperature above about 500° F. (260° C.), Desirably, the average melting point is greater than 1000° F. (540° C.) or higher, for example and 3 power plant hardware; and White Hi-Temp Anti-Seize is a non-metallic product which protects against high temperature seizing and galling of mated metal parts, up to 2000° F. (1093° C.), while demonstrating excellent lubricity and use on various metals, such as copper, brass, cast iron, steel and all alloys including stainless steel.

Recently it has become popular to place or to formulate certain adhesives, sealants, coatings and related products in a solid, stick-like form for easy transport and ready application by the end user. Examples of such products include "Semi-Solid Compositions for Removing Cured Product" (such as is described in International Patent Publication No. WO 01/92430), "Semi-Solid One- or Two-Part Compositions" (such as is described in International Patent Publication No. WO 01/92434), "Semi-Solid Primer Compositions" (such as is described in International Patent Publication No. WO 01/92435), "Spreadable Adhesive Compositions and Applicators for Use Therewith" (such as is described in International Patent Publication No. WO 01/91915) and "Polymerizable Compositions in Non-Flowable Forms" (such as is described in International Patent Publication No. WO 00/25628). All of these examples of solid adhesives, sealants and coatings and related products in a solid or semi-solid form are intended to be dispensed from a lipstick-type dispenser in which a mechanism at the base of the dispenser advances the solid or semi-solid product through an opening at the opposite end of the dispenser.

International Patent Publication No. WO 00/44528 describes a solid anti-galling agent that includes an anti-seize agent, hard waxes of long chain esters and alcohols having free carboxylic acid groups, such as candelilla or carnauba vegetable waxes, a moderate to high Viscosity petroleum oil of 500 to 6,000 SUS, and surfactant, such as propoxylated myristyl alcohol or dodecylbenzene sulfonic acid. The surfactant is included at about 15 to 25% and is apparently required to maintain the homogeneity of the components and to soften and/or wet the hard waxes used therein. Such formulations are believed to be commercial products of LA-CO Industries, Inc., Elk Grove Village, Ill., which markets an E-Z Break Twist-Stick, Copper Grade, anti-seize formulation. greater than 1600° F. (870° C). Useful, solid anti-seize lubricants include, but are not limited to, metallic powders or flakes, non-metallic lubricants, and metal oxides, hydroxides and fluorides. Non-limiting examples of metallic powders or flakes include copper, nickel, aluminum, lead, zinc, chromium, cobalt, manganese, molybdenum, and steel, such as stainless steel. Non-limiting examples of non-metallic lubricants include graphite, molybdenum disulfide, boron nitride, polyethylenefluoroethylene (PTFE), mica, and/or talc. Non-limiting examples of metal oxides, hydroxides and fluorides include calcium oxide, calcium fluoride, zinc oxide, titanium dioxide, magnesium oxide, calcium hydroxide, barium oxide and/or tin oxide.

The solid anti-seize lubricants are generally powdered or flaked materials that are ground or formed into a small or fine particle size. Generally, particles sizes are in the micron-sized ranges. Particles sizes of less than about 150 microns (or about 100 mesh) are useful. Average particles sizes of 100 microns or less (or about 150 mesh or greater) are also useful. Desirably, the average particle size is less than about 10 microns to about 60 microns.

Grease is a mixture of a fluid lubricant, usually petroleum oil or synthetic oil, and a thickener, usually soap, dispersed in the lubricant. Soap thickeners may formed by reacting, i.e., saponifying, a metallic hydroxide, or alkali, with a fat, fatty acid, or ester. The type of soap used depends on the grease properties desired. Calcium (lime) soap greases are highly resistant to water, but unstable at high temperatures. Sodium soap greases are stable at high temperatures, but wash out in moist conditions. Lithium soap greases resist both heat and moisture. Mixed-base soap is a combination of soaps, offering some of the advantages of each type. A complex soap is formed by the reaction of an alkali with a high-molecular-weight fat or fatty acid to form soap, and the simultaneous reaction of the alkali with a short-chain organic or inorganic acid to form a metallic salt (the complexing agent). Complexing agents usually increase the dropping point of grease. Lithium, calcium, and aluminum greases are common alkalis in complex-soap greases. Non-soap thickeners, such as clays, silica gels, carbon black, and various synthetic organic materials are also used in grease manufacture.

Greases useful in forming the anti-seize composition of the present invention include calcium, sodium, lithium, aluminum, bentonite clay and silica containing greases. Polymer thickened greases, such as polyurea greases are also useful. Desirably, the grease is a calcium/lithium grease having from about 5 to 10 weight percent lithium/calcium thickener combined with a base oil having a viscosity from about 300 to 350 Saybolt Universal Seconds (SUS) at 100° F. Such a grease also has a consistency or penetration useful for the anti-seize composition of the present invention.

Consistency or penetration of grease is a measure of the consistency of grease, utilizing a penetrometer. Penetration is reported as the tenths of a millimeter (penetration number) that a standard cone, acting under the influence of gravity, will penetrate the grease sample under test conditions prescribed by test method ASTM D 217. Standard test temperature is 25° C. (77° F.). The higher the penetration number, the softer the grease. Undisturbed penetration is the penetration of a grease sample as originally received in its container. Unworked penetration is the penetration of a grease sample that has received only minimal handling in transfer from its original container to the test apparatus. Worked penetration is the penetration of a sample immediately after it has been subjected to 60 double strokes in a standard grease worker; other penetration measurements may utilize more than 60 strokes. Block penetration is the penetration of block grease (grease sufficiently hard to hold its shape without a container). Desirably, creases with ASTM D 217 worked or unworked penetrations from about 200 to about 400 mm at 77° F. (25° C.) are useful with the practice of the present invention. More desirably, greases with ASTM D 217 worked or unworked penetrations from about 250 to about 350 mm at 77° F. (25° C.) are useful with the practice of the present invention.

The National Lubricating Grease Institute (NLGI) number is a series of penetration numbers classifying the consistency range of lubricating greases, based on the ASTM D 217 cone penetration number. The NLGI grades are in order of increasing consistency (hardness). Desirably, the grease used with the practice of the present invention has a NLGI grade from about 0 to about 3, or an ASTM D 217 worked penetration from about 220 to about 385 mm at 77° F. (25° C.). More desirably, the grease used with the practice of the present invention has a NLGI grade of 2, or an ASTM D 217 worked penetration from about 265 to about 295 mm at 77° F. (25° C.).

Harder greases, such as block greases, which are solid and can maintain their shape at room temperature, or other greases with higher NLGI grades or lower penetration values, may not result in good spreadability, i.e., an even coating without gaps on a substrate that is easily applied by simply rubbing the composition over the substrate, of the anti-seize composition. Softer greases may improve spreadability, but may result in poor dimensional stability of a solid anti-seize composition.

The anti-seize composition further includes an oil to control, in part, the spreadability of the composition. Useful oils include petroleum oils; mineral oils; synthetic oils, such as silicone oils, ester-based oils, olefin-based oils, glycol oils, and the like; vegetable oils, such as castor oil, coconut oil, corn oil, cotton seed oil, linseed oil, palm oil, and the like; and animal oils, such as fish oils, sperm oil, and the like.

Desirably, the oil is a severely hydrotreated, naphthenic oil derived from petroleum. Useful severely hydrotreated, naphthenic oils include oils having a viscosity of about 80 to 300 SUS at 100° F. and an API gravity of about 22 to 26 at 60° F. More desirably, the severely hydrotreated, naphthenic oils include oils having a viscosity of about 100 to 110 SUS at 100° F. and an API gravity of about 24.5 to 25.5 at 60° F.

The anti-seize composition also includes a polymeric matrix. The polymeric matrix includes an organic material which generally has a melting point or softening point range in the range of about 150° F. (65° C.) to about 500° F. (260° C.), more desirably from about 180° F. (82° C.) to about 300° F. (150° C.). Polymeric matrix materials useful in the present invention may be selected from polyamides, polyacrylamides, polyimides, polyhydroxyalkylacrylates, urea-urethanes, hydroxy or amine modified aliphatic hydrocarbons (such as castor oil-based rheological additives), liquid polyester-amide-based rheological additives and combinations thereof. Of particular utility are hydroxy or amine modified aliphatic hydrocarbons and liquid polyester-amide-based rheological materials having a melting point of about 170° F. to about 200° F. (76° C. to 93° C.).

Non-limiting examples of hydroxyl, amide or amine modified aliphatic a hydrocarbons include THIXCIN R, THIXCIN GR, THIXATROL ST and THIXATROL GST available from Rheox Inc., Hightstown, N.J. These modified aliphatic hydrocarbons are castor oil based materials, The hydroxyl modified aliphatic hydrocarbons are partially dehydrated castor oil or partially dehydrated glycerides of 12-hydrostearic acid. These hydrocarbons may be further modified with polyamides to form polyamides of hydroxyl stearic acid. Certain of the THIXCIN products include metallic additives, as well. Desirably, the hydroxy, amide or amine modified aliphatic hydrocarbon is THIXCIN R.

Liquid polyester-amide based rheolgical additives include THIXATROL TISR, THIXATROL SR and THIXATROL VF rheological additives available from Rheox Inc., Hightstown, N.J. These Theological additives are described to be reaction products polycarboxylic acids, polyamines, alkoxylated polyols and capping agents. Useful polycaboxylic acids include sebacic acid, poly(butadiene) dioic acids, dodecane dicarboxylic acid and the like. Suitable polyamines include diamine alkyls. Capping agents are described as being monocarboxylic acids having aliphatic unsaturation.

The present invention includes the polymeric matrix, such as the above-mentioned hydroxyl, amide or amine modified aliphatic hydrocarbons, often in amounts of about 2% to about 20% by weight of the total composition. When present in these amounts, the non-flowability characteristics of a composition can be obtained with minimal undesirable effects. such as loss of anti-seize lubrication or spreadability characteristics. The constituents of the anti-seize composition should be heated, such as when the anti-seize lubricants and the polymeric matrix are mixed together. For instance, it is desirable to heat the mixture to about 100° C. (212° F.) to improve the retractability of the end use anti seize product.

The polymeric matrix materials of the present invention desirably have a particle size less than about 100 microns, although other particle sizes are useful. Desirably, the average particle size is less than about 50 microns.

Another polymeric matrix useful herein includes polyamide materials. One such polyamide has a melting point of about 260° F. (127° C.) and is commercially available as a non-reactive free flowing powder under the tradename DISPARLON 6200, from King Industries Specialties Company, Norwalk, Conn. Other polyamides include DISPARLON 6100 and 6500.

Another polymeric matrix useful herein includes a combination of an alkali metal cation and the reaction product of (a) a polyfunctional isocyanate and an hydroxy and an amine; or (b) a phosgene or phosgene derivative, and a compound having 3 to 7 polyethylene ether units terminated at one end with an ether group and at the other end with a reactive functional group selected from an amine, an amide, a thiol or an alcohol; or (c) a monohydroxy compound, a diisocyanate and a polyamine. When the reaction product described in (c) is employed it is generally formed by first reacting a monohydroxy compound with a diisocyanate to form a mono-isocyanate adduct, and subsequently reacting the mono-isocyanate reaction product with a polyamine in the presence of an alkali metal salt and aprotic solvent, as described in U.S. Pat. No. 4,314,924, the disclosure of which is hereby expressly incorporated herein by reference. A commercially available version of the reaction product described in (c) is believed to be BYK-410, from BYK-Chemie, Wallingford, Conn. BYK-Chemie describes this reaction product as a urea-urethane.

Useful isocyanates for forming the reaction product(s) of the additive include polyisocyanates such as phenyl diisocyanate, toluene diisocyanate, 4,4'-diphenyl diisocyanate, 4,4'-diphenylene methane diisocyanate, dianisidine diisocyanate, 1,5-naphthalene diisocyanate, 4,4'-diphenyl ether diisocyanate, p-phenylene diisocyanate, 4,4'-dicyclo-hexylmethane diisocyanate, 1,3-bis-(isocyanatomethyl) cyclohexane, cyclohexylene diisocyanate, tetrachlorophenylene diisocyanate, 2,6-diethyl-p-phenylenediisocyanate, and 3,5-diethyl-4,4'-diisocyanatodiphenylmethane. Still other polyisocyanates that may be used are polyisocyanates obtained by reacting polyamines containing terminal, primary and secondary amine groups or polyhydric alcohols, for example, the alkane, cycloalkane, alkene and cycloalkane polyols such as glycerol, ethylene glycol, bisphenol-A, 4,4'-dihydroxy-phenyldimnethylmethane-substituted bisphenol-A, and the like, with an excess of any of the above-described isocyanates.

Useful alcohols for reacting with the polyisocyanates also include polyethyl glycol ethers having 3-7 ethylene oxide repeating units and one end terminated with an ether or an ester, polyether alcohols, polyester alcohols, as well as alcohols based on polybutadiene. The specific type of alcohol chosen and the molecular weight range can be varied to achieve the desired effect. Generally, monohydroxy compounds, straight or branched chain aliphatic or cyclic primary or secondary alcohols containing $C_{5-25}$, and alkoxylated derivatives of these monohydroxy compounds are useful.

Phosgene and phosgene derivatives, such as bischloroformates, may be used to make the reaction product of the additive (c). These compounds are reacted with a nitrogen-containing compound, such as an amine, an amide or a thiol to form the adduct. Phosgenes and phosgene derivatives may also be reacted with an alcohol to form the reaction product.

The alkali metal cations are usually provided in the form of a halide salt. For example, sodium, potassium and lithium halide salts are useful. In particular, sodium chloride, sodium iodide, sodium bromide, potassium chloride, potassium iodide, potassium bromide, lithium chloride, lithium iodide, lithium bromide and combinations thereof may be employed.

The reaction products of additive (c) of the present invention are usually present in and added to the composition with an alkali metal salt, in a solvent carrier. The solvents are desirably polar aprotic solvents in which the reaction to form the reaction product was carried out. For example, N-methyl pyrrolidone, dimethylsulfoxide, hexamethylphosphoric acid triamide, N,N-dimethylformamide, N,N,N',N'-tetramethylurea, N,N-dimethylacetamide, N-butylpyrrolidone, tetrahydrofuran and diethylether may be employed.

One particularly desirable additive is the combination of a lithium salt and a reaction product which is formed by reacting a monohydroxy compound with a diisocyanate compound to form a mono-isocyanate first adduct, which is subsequently reacted with a polyamine in the presence of lithium chloride and 1-methy-2-pyrrolidone to form a second adduct. A commercially available additive of this sort is sold by BYK-Chemie, Wallingford, Conn. under the tradename BYK 410. This commercially available additive is described by BYK-Chemie product literature as being a urea urethane having a minor amount of lithium chloride present in a 1-methyl-2 pyrrolidone solvent.

Amines which can be reacted with phosgene or phosgene derivatives to make the reaction product include those which conform to the general formula $R^{11}$—$NH_2$, where $R^{11}$ is aliphatic or aromatic. Desirable aliphatic amines include polyethylene glycol ether amines. Desirable aromatic amines include those having polyethylene glycol ether substitution on the aromatic ring.

For example, commercially available amines sold under the tradename JEFFAMINE by Huntsman Corporation, Houston, Tex., may be employed. Examples include JEFFAMINE D-230, JEFFAMFNE D-400, JEFFAMINE D-2000, JEFFAMINE T-403, JEFFAMINE ED-600, JEFFAMRNE ED-900, JEFFAMINE ED-2001, JEFFAMINE EDR-148, JEFFAMINE XTJ-509, JEFFAMINE, T-3000, JEFFAMINE T-5000, and combinations thereof.

The JEFFAMINE D series are diamine based products and may be represented by:

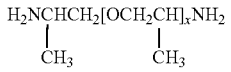

(CAS Registry No. 904610-0)

where x is about 2.6 (for JEFFAMINE D-230), 5.6 (for JEFFAMINE D-400) and 33.1 (for JEFFAMINE D-2000), respectively.

The JEFFAMINE T series are trifunctional amine products based on propylene oxide and may be represented by:

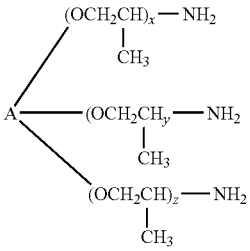

where x, y and z are set forth below in Table A.

TABLE A

| JEFFAMINE | | Approx. | Mole |
|---|---|---|---|
| Product | initiator (A) | Mol. Wt. | % |
| P-403 | Trimethylo1propane | 440 | 5-6 |
| P-3000 | Glycerine | 3,000 | 50 |
| P-5000 | Glycerine | 5,000 | 85 |

More specifically, the JEFFAMINE T-403 product is a trifunctional amine and may be represented by:

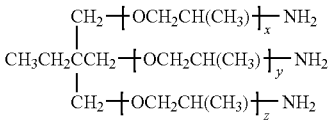

where x+y+z is 5.3, (CAS Registry No. 39423-51-3)

The JEFFAMINE ED series are polyether diamine-based products and may be represented by:

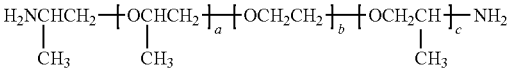

where a, b and c are set forth below in Table B.

TABLE B

| JEFFAMINE | Approx. Value | | Approx. |
|---|---|---|---|
| Product | B | a + c | Mol. Wt. |
| ED-600 | 8.5 | 2.5 | 600 |
| ED-900 | 15.5 | 2.5 | 900 |
| ED-2001 | 40.5 | 2.5 | 2,000 |

Amides useful for reacting with the phosgene or phosgene derivatives include those which correspond to the following formula:

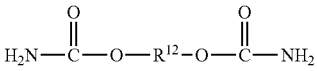

where $R^{12}$ may be an aliphatic or aromatic, substituted or unsubstituted, hydrocarbon or heterohydrocarbon, substituted or unsubstituted, having $C_{1-36}$ Alcohols useful in forming the reaction product with the phosgene or phosgene derivatives include those described above, Waxes useful as an optional component in the inventive compositions include petroleum. waxes, vegetable waxes, insect waxes, animal waxes and synthetic waxes. Waxes may be characterized by a number of physical properties, including melting point and hardness (or penetration). Penetration of a wax is a measure of the hardness of the wax, utilizing a penetrometer. Penetration is reported as the depth, in tenths of millimeter or dmm, to which a standard needle penetrates the wax under conditions described in test method ASTM D 1321. Prior to penetration, the wax sample is heated to 17° C. (30° F.) above its congealing point, air cooled, then conditioned at a test temperature in a water bath, where the sample remains during the penetration test. The test temperature may be controlled at different values depending upon the particular wax to be analyzed. For softer or unrefined waxes ASTFM D 937 prescribes the use of a cone instead of a needle.

Petroleum wax includes a range of relatively high-molecular-weight hydrocarbons (approximately $C_{16}$ to $C_{50}$), is solid at room temperature, and is derived from higher boiling petroleum fractions. Three basic categories of petroleum-derived or shale-oil-derived waxes include paraffin (crystalline) wax, microcrystalline wax and petrolatum wax. Paraffin waxes are produced from the lighter lube oil distillates, generally by chilling the oil and filtering the crystallized wax. Paraffin waxes have a distinctive crystalline structure and have a melting point range generally between 48° C. (118° F.) and 71° C. (160° F.). Paraffin wax is macrocrystalline and is composed of about 40-90 wt % normal alkanes with a remainder of $C_{18}$-$C_{36}$ isoalkanes and cycloalkanes. Fully refined paraffin has less than 1 wt %; crude scale, 1-2 wt %, and slack [64742-61-61], above 2 wt %. Paraffin wax is a petroleum-derived wax usually consisting of high-molecular-weight normal paraffins; distinct from other natural waxes, such as beeswax and carnauba wax (palm tree), which are composed of high-molecular-weight esters, in combination with high-molecular-weight acids, alcohols, and hydrocarbons. Refined paraffin waxes are low oil, or low liquid paraffin, content waxes, generally with an oil content of 1.0 weight percent or less, under conditions prescribed by test method ASTM D 721. Fully refined paraffin waxes generally have even lower oil content of about 0.5 weight percent or less wider the same conditions.

Microcrystalline waxes are produced from heavier lube distillates and residua usually by a combination of solvent dilution and chilling. They differ from paraffin waxes in having poorly defined crystalline structure. darker color, higher viscosity, and higher melting points which typically range from 63° C. (145° F.) to 93° C. (200° F.). Microcrystalline waxes contain more branched and cyclic compounds than paraffin waxes and also vary more widely than paraffin waxes in their physical characteristics. Microcrystalline waxes can be somewhat ductile, but are also often brittle and crumble easily.

Petrolatum waxes (CAS Registry No. 8009-0-8) are derived from heavy residual lube stock by propane dilution and filtering or centrifuging. They are microcrystalline in character, semisolid at room temperature and consist predominantly of saturated crystalline and liquid hydrocarbons having carbon numbers greater than $C_{25}$.

Useful insect and animal waxes include, but are not limited to, beeswax, spermaceti wax, Chinese wax. wool wax, and shellac wax. The major components of beeswax (CAS Registry No. 8012-89-3) are esters of $C_{30}$ and $C_{32}$ alcohols with $C_{16}$ acids, free $C_{25}$ to $C_{31}$ carboxylic acids, and $C_{25}$ to $C_{31}$ hydrocarbons. Beeswax typically has a melting point of about 60 to 70° C., a penetration (hardness) of about 20 dmm at 25° C. (ASTMI D1321). Spermaceti wax (CAS Registry Nos. 8002-23-1 and 68910-54-3) is derived from the sperm whale and has a melting point of about 42 to 50° C. Chinese wax (CAS Registry No. 8001-73-8) is formed on a branches of ash trees (*Fraximus chinensis*) from the secretion of the coccus insect (*Coccus ceriferus*). It is a hard wax with a melting point of about 80 to 84° C. Wool wax (CAS Registry No. 68815-23-6) or lanolin wax (CAS Registry No. 68201-49-0) is extracted from sheep's wool and has a melting point of about 36 to 43° C. Shellac wax is obtained from the lac of a scale insect (*Coccus lacca*) that feeds on certain trees in southern Asia and has a melting point of about, 79 to 82° C.

Useful vegetable waxes include, but are not limited to, carnauba wax, candelilla wax, Japan wax, ouricury, wax, rice-bran wax, jojoba wax, castor wax, bayberry wax, and soy bean wax. Carnauba wax (CAS Registry No. 8015-86-9) is produced from fronds of a palm tree. The major components of carnauba wax are aliphatic and aromatic esters of long-chain alcohols and acids, with smaller amounts of free fatty acids and alcohols, and resins. Carnauba wax is very hard with a penetration of about 2 dmm at 25° C. and has a melting point of about 83 to 86° C. Candelilla wax (CAS Registry No. 8006-44-8) is produced from shrubby spurges (*Euphorbia antisyphilitica*) native to southwest Texas and Mexico. The major components of candelilla wax are hydrocarbons, esters of long-chain alcohols and acids, long-chain alcohols, sterols, and neutral resins, and long-chain acids. Typically, candelilla wax has a melting point of about 67 to 70° C. and a penetration of about 3 dmm at 25° C. Japan wax (CAS Registry No. 8001-39-6) is derived from the berries of a small tree native to Japan and China cultivated for its wax. Japan wax is composed of triglycerides, primarily tripalmitin. Japan wax typically has a melting point of about 48 to 53° C. Ouricury wax (CAS Registry No. 68917-70-4) is a brown wax obtained from the fronds of a palm tree which grows in Brazil and has a melting point of about 79 to 84° C. Rice-bran wax (CAS Registry No. 8016-60-2) is extracted from crude rice-bran oil and has a melting point of about 75 to 80° C. The wax is primarily composed of esters of lignoceric acid, behenic acid, and $C_{22}$-$C_{36}$ alcohols. Jojoba wax (CAS Registry No. 61789-91-1) is obtained from the seeds of the jojoba plant. Castor wax (CAS Registry No. 8001-78-3) is catalytically hydrogenated castor bean oil. Bayberry wax (CAS Registry No. 8038-77-5) is obtained from the surface of the berry of the bayberry (myrtle) shrub. The wax is made up primarily of lauric, myristic, and palmitic acid esters. The wax has a melting point of about 45 to 49° C.

Useful mineral waxes include, but are not limited to, montan wax, peat wax, ozokerite wax and ceresin wax. Montan wax (CAS Registry Nos. 8002-53-7) is derived by solvent extraction of lignite. The wax components of montan is a mixture of long chain ($C_{24}$-$C_{30}$) esters, long-chain acids, and long chain alcohols, ketones, and hydrocarbons. Crude montan wax from Germany typically has a melting point of about 76 to 86° C. Peat waxes are much like montan waxes and are obtained from peat and has a melting point of about 73 to 76° C. Ozokerite wax (CAS Registry No. 001-75-0) was originally a product of Poland, Austria and the former USSR where it was mined and has a melting point of about 74 to 75° C. Ceresin wax (CAS Registry No. 8001-75-0) originally was a refined and bleached ozokerite wax.

Synthetic waxes include, but are not limited to, polyethylene waxes, polyethylene oxide waxes, polyfluoro wax, polypropylene waxes, polytetra fluoro ethylene waxes, α-olefin waxes, carbowaxes and halowaxes. Polyethylene waxes (CAS Registry No. 8002-72-4) are obtained polymerization of polyethylenes or by Fischer-Tropsch synthesis. The waxes have melting points ranging from about 45-106° C. These waxes may also be chemically modified to vary properties, such as acid number. Polymerized a-olefins can be produced to have wax-like properties and are sold as synthetic waxes. The polymerization process yields highly branched materials, with broad molecular weight distributions. Carbowaxes (CAS Registry Nos. 9004-74-4 and 25322-68-3) are high molecular weight polyethylene glycols. Halowaxes (CAS Registry Nos. 1321-65-9, 1335-87-1, 1335-88-2, 12616-35-2, 12616-36-3, 25586-43-0, 57817-66-7 and 58718-67-5) are chlorinated naphthalenes.

Desirably, the wax used in the anti-seize composition is a paraffin wax. More desirably, the wax is a refined or fully refined paraffin wax derived from petroleum or shale oil. Moderately soft waxes are also useful. For example, waxes, including paraffin waxes, with a needle penetration (ASTM D 1321) of about 8 to 30 dmm at 77° F. (25° C.) are useful. More desirably, waxes, including paraffin waxes, with a needle penetration (ASTM D 1321) of about 10 to 25 dmm at 77° F. (25° C.) are also useful. The use of such moderately soft waxes, as contrasted to harder waxes, is believed to improve the spreadability of the anti-seize composition. The use of softer waxes may result in an anti-seize composition not having adequate dimensional stability, i.e., a flowable composition as contrasted to a non-flowable composition.

Thickeners, plasticizers, pigments, dyes, diluents, fillers, and other agents common to the art can be employed in any reasonable manner to produce desired functional characteristics, providing they do not significantly interfere with the anti-seize functionality.

Generally, the inventive anti-seize compositions include a solid anti-seize lubricant in an amount from about 10 to about 60 weight percent on a total composition basis, and a carrier in an amount from about 10 to about 30 weight percent on a total composition basis. More specifically, in one aspect of the invention, the composition may include as the solid anti-seize lubricant, graphite present from about 10 to about 30 weight percent on a total composition basis and copper present from about 10 to about 30 weight percent on a total composition basis, and as the carrier, a polymeric matrix present from about 10 to about 30 weight percent on a total composition basis, grease present from about 10 to about 40 weight percent on a total composition basis, and oil present from about 20 to about 60 weight percent on a total composition basis. Desirably, the composition includes graphite present from about 20 to about 22 weight percent on a total composition basis, copper present from about 16 to about 18 weight percent on a total composition basis, polymeric matrix present from about 11 to about 17 weight percent on a total composition basis, grease present from about 12 to about 20 weight percent on a total composition basis, and oil present from about 25 to about 40 weight percent on a total composition basis.

The anti-seize stick formulations of the present invention may be prepared by placing the oil constituent and the grease constituent in a vessel and mixing these constituents of the formulation. Desirably, these constituents are mixed at about 1000 rpm under slightly elevated temperature conditions, for example 80° C. to 100° C. The matrix material may then be added, while maintaining the temperature at about 80° C. to 100° C. The actual temperature used may vary depending upon the melting point of the matrix material. After the matrix material has been added, metallic powder and/or graphite may be added with the mixing speed increased to about 1500 rpm. The so-formed anti-seize formulation is dispensed into lipstick-type dispensers while hot. The dispensers are then allowed to coot to create the anti-seize stick formulations of the present invention. The matrix material may be preheated to the above-described temperatures before its addition.

One method for preparing a solid anti-seize composition includes the steps of (1) selecting a grease with an ASTM D 217 penetration at 25° C. from about 200 to about 400 tenths of a millimeter; (2) selecting a naphthenic petroleum oil with a viscosity of less than about 300 SUS at 100° F. and with an API gravity at 60° F. from about 23 to about 25; (3) mixing the grease and the oil to form a combined oil/grease composition; (4) adding and mixing into the oil/grease composition a solid anti-seize lubricant selected from the group consisting of metallic copper, metallic nickel, metallic aluminum, metallic lead, metallic zinc, graphite, calcium oxide, calcium carbonate, calcium fluoride, calcium stearate, lithium, molybdenum disulfide, boron nitride, barium sulfate, or combinations thereof; and a polymeric matrix and optionally a refined paraffinic wax, which has a viscosity of less than about 200 SUS at 100° F., to form the anti-seize composition. The method may further include the steps of heating polymeric matrix and/or wax or the oil/grease composition to at least 80° C.; maintaining the composition at least 80° C. while mixing; and cooling the composition to room temperature to solidify, the composition. The method may further include the steps of adding the composition at about at least 80° C. into a dispensing container having a generally elongate hollow body and having first and second ends, with one of said ends defining a dispense bottom to releasably holding the composition, followed by cooling the composition to room temperature to solidify the composition within the container.

The present invention also contemplates and article of manufacture which includes the above-mentioned non-flowable composition in a dispenser or applicator. Desirably the dispenser is a pocket-size, lipstick-type dispenser which can be carried by the mechanic or maintenance worker without fear of spillage or contamination of sensitive parts and used as needed. The dispenser typically is generally elongate in shape and designed to mechanically advance the composition through a dispense opening. The dispense opening can be defined as the entire perimeter of the container wall or it can be smaller apertures located on the end surface of the container. The perimeter or aperture which defines the dispense opening can be smooth, notched or wavy, such as in a sinusoidal wave. Additionally, a portion of the dispense end of the container can be concave to accommodate a threaded member or tubular body which requires application of the composition.

Alternatively, the dispense end of the container may have a dispense opening which is defined by apertures such as slots or holes on the top surface. These apertures can be combined with other features described above, such as the concave surface or perimeter for accommodating threaded members or other cylindrical parts.

The container is generally fitted with a cap which fits over and around the container walls. The cap can also be designed at its closed end to have the concave portion and/or apertures as defined previously.

At the container end opposite, i.e., the bottom end of the container, the dispense opening is proximally located a mechanism for mechanically advancing the anti-seize composition. These mechanisms are generally well known in the art and include a pusher means which can include a knob located at the bottom of the container which when turned in one direction advances the anti-seize composition contained therein to the dispense opening and when turned in the other direction moves the anti-seize composition in the opposite direction.

The article of manufacture can be more particularly described referring to FIGS. 1-11. FIG. 1 shows dispense container 10 having a generally elongate tubular shape defined by wall 20 and having a dispense end defined by perimeter 21. Cap 50 as shown is designed for closingly engaging tubular wall 20 by fitting thereover.

Figure 2:
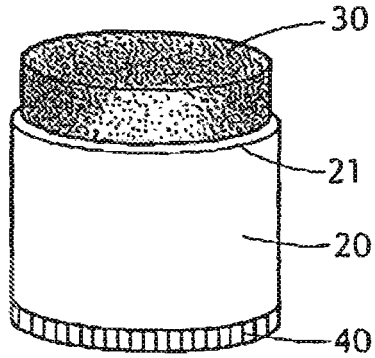
FIG. 2 is a perspective view of a lipstick-type container showing the anti-seize composition of the present invention contained therein.

Composition 30 is shown in FIG. 1 within container 10. FIG. 2 shows composition 30 being advanced above perimeter 21 using knurled knob 40, which was turned to advance the composition. Turning knob 40 in the opposite direction causes composition 30 to descend back within the container.

Figure 3:
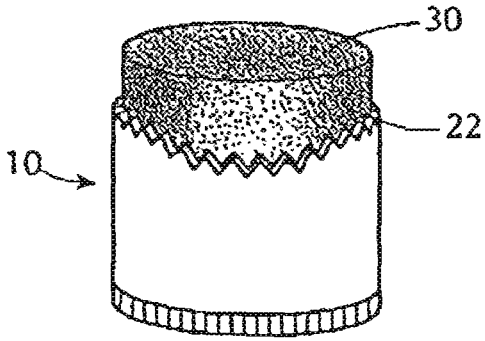
FIG. 3 is a perspective view of a dispenser container showing a notched rim at the dispense opening.
Figure 4:
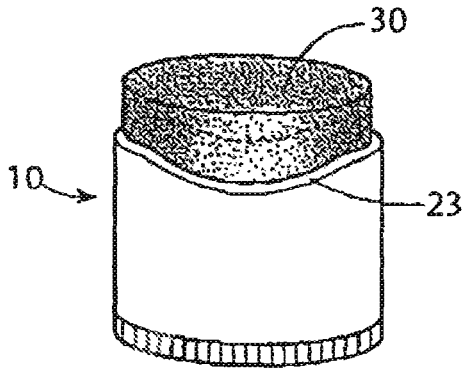
FIG. 4 shows a dispense container having a concave section at its dispense opening for receiving geometrically complimentary parts.
Figure 5:
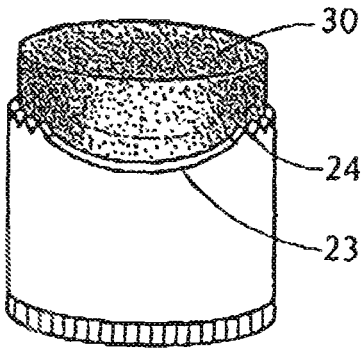
FIG. 5 shows a dispense container having both a concave section and a notched section at its dispense opening rim.

FIG. 3 shows container 10 having a dispense perimeter defining the opening being notched. Such a design could alternatively be sinusoidal or have other geometric shape which can be tailored to the type of surface on which the composition is to be applied. For example, FIG. 4 shows container 10 having opposed concave surfaces in its perimeter 23 for accommodating parts having rounded surfaces such as a bolt, screw or rod-like parts. FIG. 5 shows a combination of opposed concave surfaces in perimeter 24 in combination with oppositely opposed geometric portions of the same perimeter.

Figure 6:
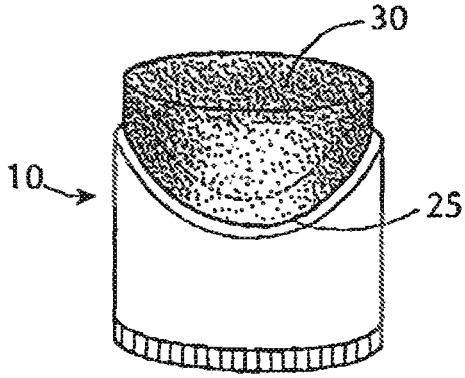
FIG. 6 is a perspective view of a dispensing container showing the dispense opening being concave.

FIG. 6 shows container 10 having a large portion of its perimeter 25 having opposed concave portions.

Figure 7:
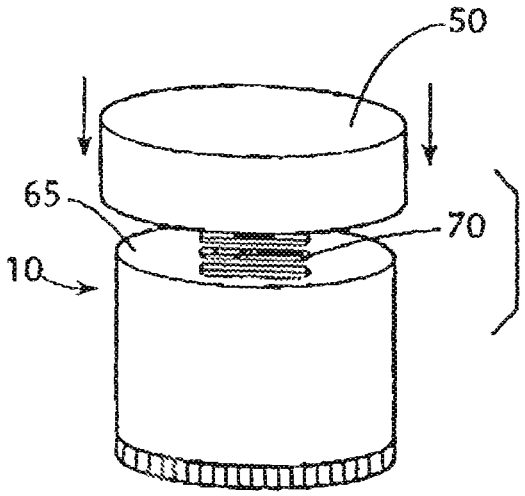
FIG. 7 is a perspective view of a container and cap showing the dispense opening defined by slotted apertures.

FIG. 7 shows container 10 having a dispense end with end surface 65 and elongate apertures 70 through which the composition is dispensed.

Figure 8:
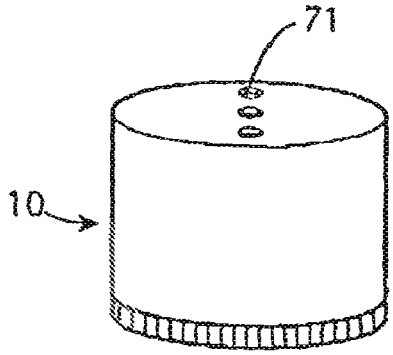
FIG. 8 shows a perspective view of a container and cap having the dispense opening defined by generally circular apertures.

FIG. 8 shows a different aperture shape in the form of a generally circular aperture 71.

Figure 9:
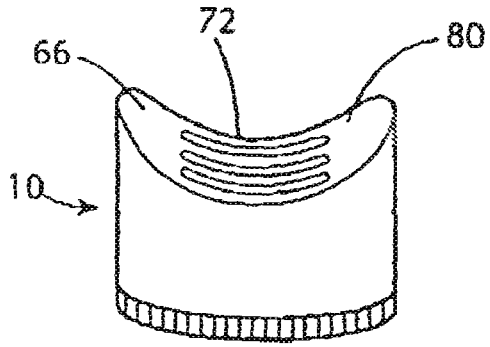
FIG. 9 is a perspective view of a dispense container and cap showing the dispense opening having a concave surface portion and slotted apertures therein.
Figure 10:
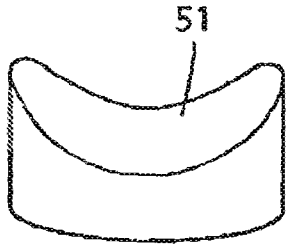
FIG. 10 is a perspective view of a cap for a dispense container with one end being concave.
Figure 11:
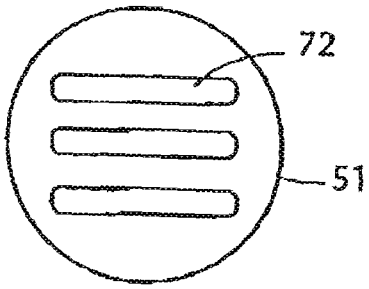
FIG. 11 shows a top view of the cap of FIG. 10 showing elongate apertures for dispensing compositions.

FIG. 9 shows container 10 having an end surface 66 in which aperture 72 are both elongate and concave since they follow the geometry of the end surface 66. Cap 51 for this container fits around perimeter 80 and may be designed with or without apertures. In FIGS. 10 and 11, the design with apertures is shown, where cap 51 has elongate apertures which can be opened or closed by closure means, not shown, and which can be fitted over perimeter 80.

The following non-limiting examples are intended to further illustrate the present invention.

EXAMPLES

Non-flowable anti-seize compositions were prepared in accordance with the formulations set forth below.

The compositions were prepared by placing a naphthenic oil and lithium/calcium grease in a vessel and mixing these constituents of the formulation at about 1000 rpm. While mixing, these constituents were heated to about 92° C. (200° F.). Polymeric matrix, THIXCIN R, was then added while the temperature and mixing were maintained. While mixing, metal and/or non-metal powder was then added, followed by the addition of the synthetic graphite. Mixing continued for 10 minutes. The so-formed anti-seize formulations were dispensed into lipstick-type dispensers while hot. The dispensers were then allowed to cool to create the anti-seize stick formulations of the present invention A.1--Aluminum Anti-Seize Stick

| Component | Wt. % |
|---|---|
| 100-V Napthenic Base Oil | 39 |
| Lithium/calcium grease | 10 |
| THIXCIN R | 13 |
| Aluminum Powder 805 | 6 |
| 5026 Graphite | 17 |
| Calcium Oxide | 15 |

A.2--Aluminum Anti-Seize Stick

| Component | Wt. % |
|---|---|
| 100-V Napthenic Base Oil | 39 |
| Lithium/calcium grease | 10 |
| THIXCIN R | 13 |
| Aluminum Powder 805 | 15 |
| 5026 Graphite | 21 |
| Copper | 2 |
| Calcium Oxide | — |

A.3--Aluminum Anti-Seize Stick

| Component | Wt. % |
|---|---|
| 100-V Napthenic Base Oil | 39 |
| Lithium/calcium grease | 10 |
| THIXCIN R | 13 |

-continued

A.3--Aluminum Anti-Seize Stick

| Component | Wt. % |
|---|---|
| Aluminum Powder 805 | 6 |
| 5026 Graphite | 17 |
| Copper | 2 |
| Calcium Oxide | 13 |

B--Copper (C5-A) Anti-Seize Stick

| Component | Wt. % |
|---|---|
| 100-V Napthenic Base Oil | 36 |
| Lithium/caicium grease | 13 |
| THIXCIN R | 13 |
| 5050D Copper | 17 |
| 5026 Graphite | 21 |

C--Nickel Anti-Seize Stick

| Component | Wt. % |
|---|---|
| 100-V Napthienic Base Oil | 39 |
| Lithium/calcium grease | 10 |
| THIXCIN R | 13 |
| Graphite 5026 | 21 |
| Nickel 123 | 17 |

D--Heavy Duty Anti-Seize Stick

| Component | Wt. % |
|---|---|
| 100-V Napthenic Base Oil | 39 |
| Lithium/calcium grease | 10 |
| THIXCIN R | 13 |
| Graphite 5026 | 14 |
| Calcium Stearate | 6 |
| Calcium Fluoride | 18 |

E--Marine Grade Anti-Seize Stick

| Component | Wt. % |
|---|---|
| 100-V Napthenic Base Oil | 38 |
| THIXCIN R | 12 |
| Calcium Sulfonate Grease | 9 |
| Boron Nitride | 3.1 |
| Calcium Stearate | 6.2 |
| Calcium Oxide | 18.35 |
| Graphite 5026 | 12.4 |
| Lithium Sulfate | 0.95 |

F--Moly Paste Anti-Seize Stick

| Component | Wt. % |
|---|---|
| 100-V Napthenie Base Oil | 30 |
| Lithium/calcium grease | 5 |
| THIXCIN R | 11 |
| Aluminum Stearate | 1 |
| Molybdenum Disulfide | 52 |
| Barium Sulfonate | 1 |

G--White Hi-Temp Anti-Seize Stick

| Component | Wt. % |
|---|---|
| 100-V Napthenic Base Oil | 39 |
| A1 complex grease | 10 |
| THIXCIN R | 13 |
| Titanium Dioxide | 2.7 |
| Calcium Oxide | 11 |
| Mica C-3000 | 11 |
| Boron Nitride | 2.3 |
| Calcium Fluoride | 11 |

H--N-5000 Anti-Seize Stick

| Component | Wt. % |
|---|---|
| White Mineral Oil | 49 |
| THIXCIN R | 13 |
| Graphite 3144 | 22 |
| Nickel Flake | 16 |

I--N-7000 Anti-Seize Stick

| Component | Wt. % |
|---|---|
| White Mineral Oil | 45 |
| THIXCIN R | 13 |
| Calcium Stearate | 7 |
| Graphite 3144 | 15 |
| Calcium Oxide | 20 |

J

| Component | Wt. % |
|---|---|
| 100-V Napthenic Base Oil | 36 |
| Lithium/calcium grease | 13 |
| THIXCIN GR | 13 |
| 5050D Copper | 17 |
| 5026 Graphite | 21 |

Certain physical properties for the compositions designated as A.1, A.2, A.3 and B are presented below The physical properties for compositions A.1, A.2 and A.3 are reported as averages of three replicates, whereas the physical properties for composition B are reported as averages of five replicates, save for average breakaway torque, which was reported as an average of three replicates.

| Physical Property | Composition | | | |
|---|---|---|---|---|
| | A.1 | A.2 | A.3 | B |
| Color | Aluminum | Aluminum | Aluminum | Copper |
| Unworked Penetration, ASTM D 217 (dmm) | 36 | 33 | 35 | 38 |
| ¼ inch Retractibility @ 73° F. (23° C.) | Pass | Pass | Pass | pass |
| Dimensional Stability @ 170° F. (79.5° C.), 24 Hrs | Pass | Pass | Pass | pass |
| Anti Seize on 18-8 SS, BT/PT@1200° F., 24 hrs (in-lbs) | — | — | — | 532/43 |
| Anti Seize on 18-8 SS, BT/PT@1500° F., 24 hrs (in-lbs) | — | — | — | 439/279 |
| Anti Seize on 18-8 SS, BT/PT@1800° F., 24 hrs (in-lbs) | 71/0 | 110/0 | — | — |
| Max. Breakaway Torque, MIL-907E Spec. (ft-lbs) | — | — | — | <250 |
| Avg. Breakaway Torque, MIL-907E Spec. (ft-lbs) | — | — | — | 133 |
| Copper Corrosion. ASTM D130, 24 hrs@212° F. | — | — | — | Slight Tarnish 1A |
| Water Washout@100° F. ASTM D1264 (% Washout) | — | — | — | 0.5 |
| Oil Separation, FTM 791C, 321-3@140° F. (%) | — | — | — | 0.0 |

Composition B performed much like LOCTITE Copper (C5-A) Anti-Seize Lubricant in terms of anti seize properties and average breakaway torque, and even showed improved % water washout and % oil separation, which were 4 and 2.15, respectively, for LOCTITE Copper (C5-A) Anti-Seize Lubricant.

Compositions A.1 and A.2 performed much like LOCTITE Silver grade (767) Anti-Seize Lubricant. Compositions A.1 and A.2 were tested on ⅜"-16×1, 18-8 stainless steel bolts, with matching 18-8 stainless steel nuts and washers on an Inconel 600 high temperature block. Both nut and bolt threads were evenly coated with the anti-seize compositions A.1 or A.2. The nut was run on the end of the bolt to form an assembly, which was tightened with a Snap-On torque wrench to 360 in-lbs. and exposed to the specified temperature for 24 hours. Then the assembly was allowed to cool to room temperature. The nuts were loosened and breakaway and prevailing torque were measured.

What is claimed is:

1. An anti-seize composition dispensable at room temperature without the application of heat and having a Mil-907-E breakaway torque of less than 12 KPa and being non-flowable at temperatures greater than about 50° (120° F.) comprising:

a solid anti-seize lubricant selected from the group consisting of metallic powders or flakes, non-metallic lubricants, and metal oxides, hydroxides and fluorides; and a carrier having said anti-seize lubricant dispersed therein, said carrier including at least one grease, and at least one polymeric matrix.

2. The composition of claim 1, wherein said solid anti-seize lubricant is selected from the group consisting of copper, nickel, aluminum, lead, zinc, chromium, cobalt, manganese, molybdenum, steel, and combinations thereof, metallic copper, metallic nickel, metallic aluminum, metallic lead, metallic zinc, graphite, calcium oxide, calcium carbonate, calcium fluoride, calcium stearate, lithium, molybdenum disulfide, boron nitride, barium sulfate, and combinations thereof; graphite, molybdenum disulfide, boron nitride, polyethylene-fluoroethylene, mica, talc, and combinations thereof; and zinc oxide, titanium dioxide, magnesium oxide, calcium hydroxide, barium oxide, tin oxide, and combinations thereof.

3. The composition of claim 1, wherein said solid anti-seize lubricant has a particle size of less than 150 microns.

4. The composition of claim 1, wherein said grease is calcium grease, sodium grease, lithium grease, aluminum grease, or combinations thereof.

5. The composition of claim 1, wherein said grease has an ASTM D 217 penetration at 25° C. from about 200 to about 400 and an ASTM D 217 worked penetration at 25° C. from about 220 to about 385.

6. The composition of claim 1, wherein said grease is a number two grease.

7. The composition of claim 6, wherein said grease is a calcium-lithium grease.

8. The composition of claim 1 wherein the carrier further comprises at least one oil.

9. The composition of claim 8, wherein said oil is a naphthenic petroleum oil, having a viscosity of about 17.58 to about 66 cSt (about 80 to about 300 SUS) at 37° C. (100° F. ) and having an APT gravity at 15° C. (60° F.) from about 22 to about 26.

10. The composition of claim 1, wherein said polymeric matrix is a polymeric material selected from the group consisting of polyamides, polyacrylamides, polyimides, polyhydroxyalkylacrylates, urea-urethanes, hydroxy or amine modified aliphatic hydrocarbons, liquid polyesteramide-based rheological additives or combinations thereof.

11. The composition of claim 1, wherein said polymeric matrix is present in an amount of 2% by weight to 20% by weight of the total composition.

12. The composition of claim 1, wherein said polymeric matrix is a hydroxyl- or an amine-modified aliphatic hydrocarbon polymeric material having a melting point from 76° C. to 93° C. (about 170° F. to about 200° F.)

13. The composition of claim 1, wherein said polymeric matrix is a hydroxyl-modified aliphatic hydrocarbon having an unworked ASTM D 217 penetration at 25° C. from about 2 to about 10 mm (about 20 to about 100 dmm).

14. The composition of claim 1, wherein said solid anti-seize lubricant is present from about 10 to about 60 percent by weight on a total composition basis, and said carrier polymeric matrix is present in an amount of about 10 to about 30 percent by weight of the total composition.

15. The composition of claim 1, wherein the carrier includes at least one wax selected from group consisting of paraffin wax, petrolatum wax, microcrystalline wax, animal wax, vegetable wax, synthetic wax, and combinations thereof.

16. The composition of claim 15, wherein said wax is refined paraffinic wax.

17. The composition of claim 16, wherein said refined paraffinic wax is a soft wax.

18. The composition of claim 17, wherein said refined paraffinic wax has an ASTN D1321 needle penetration at 25° C. from about 1 to about 3 mm (about 10 to about 30 dmm).

19. An article of manufacture comprising:

a. a dispensing container for housing and returnably dispensing a non-flowable anti-seize composition, said container comprising a generally elongate hollow body having first and second ends, with one of said ends defining a dispense opening;

b. the solid anti-seize composition of claim 1 within said container.

20. A method of using the article of claim 19 comprising:

dispensing a portion of said anti-seize composition from said dispense opening;

applying an amount of said portion of said anti-seize composition onto a threaded surface of a substrate; and retracting an unapplied amount of said portion of said composition through said dispense opening and into said elongate hollow body.

21. The composition of claim 1, wherein said anti-seize composition is dimensionally stable up to 55° C. (130° F.)

22. The composition of claim 1, wherein said composition is non-flowable at temperatures between 49° C. and 54° C.

23. The composition of claim 1, wherein the anti-seize composition includes a solid anti-seize lubricant in an amount from about 10 to about 60 percent by weight of the total composition, and a carrier in an amount from about 10 to about 30 percent by weight of the total composition.

24. The composition of claim 1, wherein the solid anti-seize lubricant comprises graphite present from about 10 to about 30 weight percent on a total composition basis and copper present from about 10 to about 30 percent by weight of the total composition, and the carrier comprises a polymeric matrix present from about 10 to about 30 percent by weight of the total composition and grease present from about 10 to about 40 percent by weight of the total composition, and the carrier further comprises oil present from about 20 to about 60 percent by weight of the total composition.

25. The composition of claim 1, wherein the solid anti-seize lubricant comprises graphite present from about 20 to about 22 percent by weight of the total composition and copper present from about 16 to about 18 percent by weight of the total composition, and the carrier comprises a polymeric matrix present from about 11 to about 17 percent by weight of the total composition, a grease present from about 12 to about 20 percent by weight of the total composition, and the carrier further comprises an oil present from about 25 to about 40 percent by weight of the total composition.

* * * * *